US006121897A

United States Patent [19]

Flegel

[11] Patent Number: 6,121,897

[45] Date of Patent: Sep. 19, 2000

[54] DEDICATED TRANSFER SWITCH FOR A SINGLE ELECTRICAL LOAD, SUCH AS A TRAFFIC SIGNAL

[75] Inventor: David D. Flegel, Racine, Wis.

[73] Assignee: Reliance Controls Corporation, Racine, Wis.

[21] Appl. No.: 09/129,591

[22] Filed: Aug. 5, 1998

[51] Int. Cl.[7] ..... G08G 1/095

[52] U.S. Cl. ..... 340/907; 340/693.2

[58] Field of Search ..... 340/907, 906, 340/931, 912, 916, 693.2, 333; 701/99, 117, 114

[56] References Cited

U.S. PATENT DOCUMENTS

| | | | |
|---|---|---|---|
| 2,229,729 | 1/1941 | Emle . | |
| 2,865,017 | 12/1958 | Heikes | 340/907 |
| 2,997,691 | 8/1961 | Stoll | 340/907 |
| 3,041,420 | 6/1962 | Berry et al. . | |
| 3,641,487 | 2/1972 | Rogers et al. | 340/907 |
| 4,013,849 | 3/1977 | Brown | 200/51.09 |
| 5,208,584 | 5/1993 | Kaye et al. | 340/907 |
| 5,486,664 | 1/1996 | Lamp et al. . | |
| 5,612,596 | 3/1997 | Wiese | 340/907 |
| 5,659,305 | 8/1997 | Rains et al. | 340/931 |
| 5,898,389 | 4/1999 | Deese et al. | 340/907 |

*Primary Examiner*—Jeffery A. Hofsass
*Assistant Examiner*—Anh V. La
*Attorney, Agent, or Firm*—Andrus, Sceales, Starke & Sawall, LLP

[57] ABSTRACT

A transfer switch is connected to an electric traffic signal for switching power from an electrical utility source to a generator power source in the event of an interruption in the electrical utility source. The transfer switch includes an enclosure operably connected to the traffic signal and having a power input receptacle cooperable with a selector switch. The power input receptacle selectively receives the generator power source and supplies generator power to the traffic signal, while the selector switch selects the source of electrical power to the traffic signal and effects a cut off in the supply of power to the traffic signal.

25 Claims, 2 Drawing Sheets

DEDICATED TRANSFER SWITCH FOR A SINGLE ELECTRICAL LOAD, SUCH AS A TRAFFIC SIGNAL

BACKGROUND AND SUMMARY OF THE INVENTION

This invention relates generally to switching devices used to change the source of an incoming power supply to an electrical load. More particularly, the invention relates to a dedicated transfer switch for use on an electrical load, such as a traffic signal, that allows an alternate power source to be connected to the load when the primary power source is interrupted.

Most electrical devices or loads receive electrical power from a utility, and thus become inoperable when the utility power supply is interrupted for any reason. With some devices or loads, a period of inoperability is tolerable. However, with other devices or loads, it is necessary to provide an alternative means for performing the function of the load or device during the time the load or device is inoperable. For example, when a traffic signal is rendered inoperable due to interruption of its normal power supply, one alternative is to place temporary stop signs at certain comers of an intersection to control traffic flow. Frequently, stop signs are placed at all corners. While this solution controls traffic, it does so in a far less efficient manner than traffic signals. During periods of high traffic volume, a significant amount of congestion can occur at an intersection where this solution is employed during a period of power interruption. Alternatively, a police officer or the like can be positioned at an intersection where a traffic signal is inoperable, so as to direct traffic through the intersection. Again, however, this results in a less than optimal traffic flow through the intersection and requires use of personnel.

While the above solutions are generally satisfactory to control traffic at an uncontrolled intersection during interruption of power to traffic signals, both have significant drawbacks. It is thus desirable to operate traffic signals from an alternate power source when supply of utility power to the traffic signals is interrupted.

In another example, interruption of utility power cuts off the supply of water to all users of a community well. While this is initially an inconvenience, it can become a serious situation if the interruption endures for a long period of time.

It is an object of the present invention to provide an arrangement for supplying power to an electrical device or load, such as a traffic signal or community well, from an alternate power source when the supply of utility power is interrupted. It is a further object of the invention to provide the ability to quickly and efficiently connect an alternate power supply to an electrical device or load. Yet another object of the invention is to provide a power transfer device which is relatively simple and inexpensive, and which is operable to quickly change the source of incoming power to an electrical device or load, such as from a standby generator. A still further object of the invention is to provide a power supply transfer switch which can be placed in any location as desired along the path of incoming power to the load or device.

In accordance with one aspect of the invention, a transfer switch is interconnected in the power supply system for an electrical load or device. The transfer switch includes an input arrangement having a power input receptacle and a selector switch, and is wired into the power supply to the load or device. The selector switch is operable to select the source of power to the load or device, and is also operable to cut off the supply of power to the load or device. During periods of normal operation, the selector switch is set to allow power to be supplied to the load or device from primary or utility power lines which are interconnected with the transfer switch and the load or device. In order to service the load or device, the selector switch is set to a position which cuts off the supply of power to the load or device. When utility power to the load or device is interrupted and it is desired to supply power to the load or device from an alternate source of electrical power, such as a standby generator, a plug associated with a power input cord from the generator is engaged with the power input receptacle to supply input power from the generator to the transfer switch. The selector switch is then positioned so as to supply power to the load or device from the generator, and the load or device can then be operated for as long as desired from the standby generator, typically until utility power to the load or device is restored. In this manner, the only period of interruption in operation of the load or device is the time it takes to connect the standby generator to the load or device, and the load or device can thus be operated in a normal manner with minimal disruption in service.

The transfer switch preferably includes a box-like enclosure having a top wall, a bottom wall, a rear wall, and a pair of sidewalls defining an internal cavity having an open face. A partition is mounted in the internal cavity defined by the enclosure, and divides the internal cavity into an inner portion and an outer portion. The power input receptacle and the selector switch are both mounted on the partition such that the power input receptacle and the selector switch are accessible from the open face of the enclosure. The enclosure further includes a removable cover pivotally connected between open and closed positions relative to the open face by a hinge assembly located between the enclosure and the cover to selectively allow and prevent access to the power input receptacle and the selector switch. The cover includes a latch engageable with a locking mechanism secured on the enclosure opposite the hinge assembly. The power input receptacle and the selector switch are interconnected to the load, the primary power source, the alternate power source and a ground connection on the enclosure by wiring retained in the inner portion of the enclosure. The rear wall of the enclosure is formed with a knock-out opening through which the wiring extends. The bottom wall of the enclosure is provided with a retainer notch allowing a power cord leading from the plug connector to the alternate power source to extend freely from the enclosure when the cover is in the closed position over the outer portion of the enclosure. The partition includes an upper angled positioning plate having a mounting portion and a lower angled positioning plate connected thereto. The power input receptacle extends through and is fixed to mounting portion of the partition. The power input receptacle includes a cylindrical body and a circular collar extending generally perpendicularly to the body at one end thereof and overlying the mounting portion of the partition. The power input receptacle further includes a recessed end wall spaced from the collar for mounting a set of male prongs receivable in the plug connector connected to the alternate power source. The selector switch is connected to an incoming primary power supply wire and an incoming alternate power supply wire from the power input receptacle, and to an outgoing power supply wire from the selector switch leading to the load. The selector switch is selectively connectable to either incoming power supply wire. The selector switch includes a rotatable handle selectively engageable in first and second positions with the incoming power supply wires to define closed electrical circuits with the desired power source, and selectively engageable in a third position to disconnect the load from either of the incoming power supply wires.

In the preferred embodiment, the load is a traffic signal, and the enclosure is mounted on or in a control box positioned between the traffic signal and the primary power source. The enclosure may also be mounted on a support device located adjacent the traffic signal, or at any point desired along the path of the power supply to the traffic signal.

In another aspect of the invention, a transfer switch is connected to an electrical traffic signal for switching power from an electrical utility source to a generator power source in the event of an interruption in the electrical utility source. The transfer switch includes an enclosure operably connected to the traffic signal and having a power input receptacle for selectively receiving the generator power source and supplying generator power to the traffic signal, and a selector switch cooperable with the power input receptacle for selecting the source of electrical power to the traffic signal and effecting a cut off in the supply of power to the traffic signal.

The invention also relates to a method of providing a transfer of power to an electrical load, such as a traffic signal, from an electrical utility power source to a generator power source. The method is carried out by providing an enclosure having an open face, a power input receptacle mounted within the enclosure, and a selector switch mounted in the enclosure adjacent the power input receptacle and having connections with incoming power supply wires from both the electrical utility power source and the generator power source through the power input receptacle, and with an outgoing power supply wire leading to the traffic signal, and a removable cover movably attached to the enclosure for selectively allowing and preventing access to the power input receptacle and the selector switch by moving the cover to open and close the open face. The method further includes removing the cover on the enclosure exposing the power input receptacle and the selector switch; moving the selector switch from a first operative position connecting the incoming power supply wire from the utility power source with the outgoing power supply wire to an OFF position wherein the outgoing power supply wire is disconnected from both incoming power supply wires; inserting a plug leading from the generator power source into the power input receptacle; and moving the selector switch from the OFF position to a second operative position in which the outgoing power supply wire is connected to the incoming power supply wire from the generator power source. The step of removing the cover includes releasing a locking mechanism on an exterior surface of the enclosure which is engageable with a latch attached to the cover, and moving the cover away from the enclosure. The step of moving the selector switch includes rotating a handle located on the selector switch. The step of inserting the plug further includes joining the plug with the power input receptacle and placing a power cord trailing from the plug into a retainer notch formed in a bottom wall of the enclosure. Once the selector switch has been moved to its second operative position, the removable cover is closed on the enclosure and the cover is locked by engaging the latch on the cover with the locking mechanism on the enclosure.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figures 1, 2:
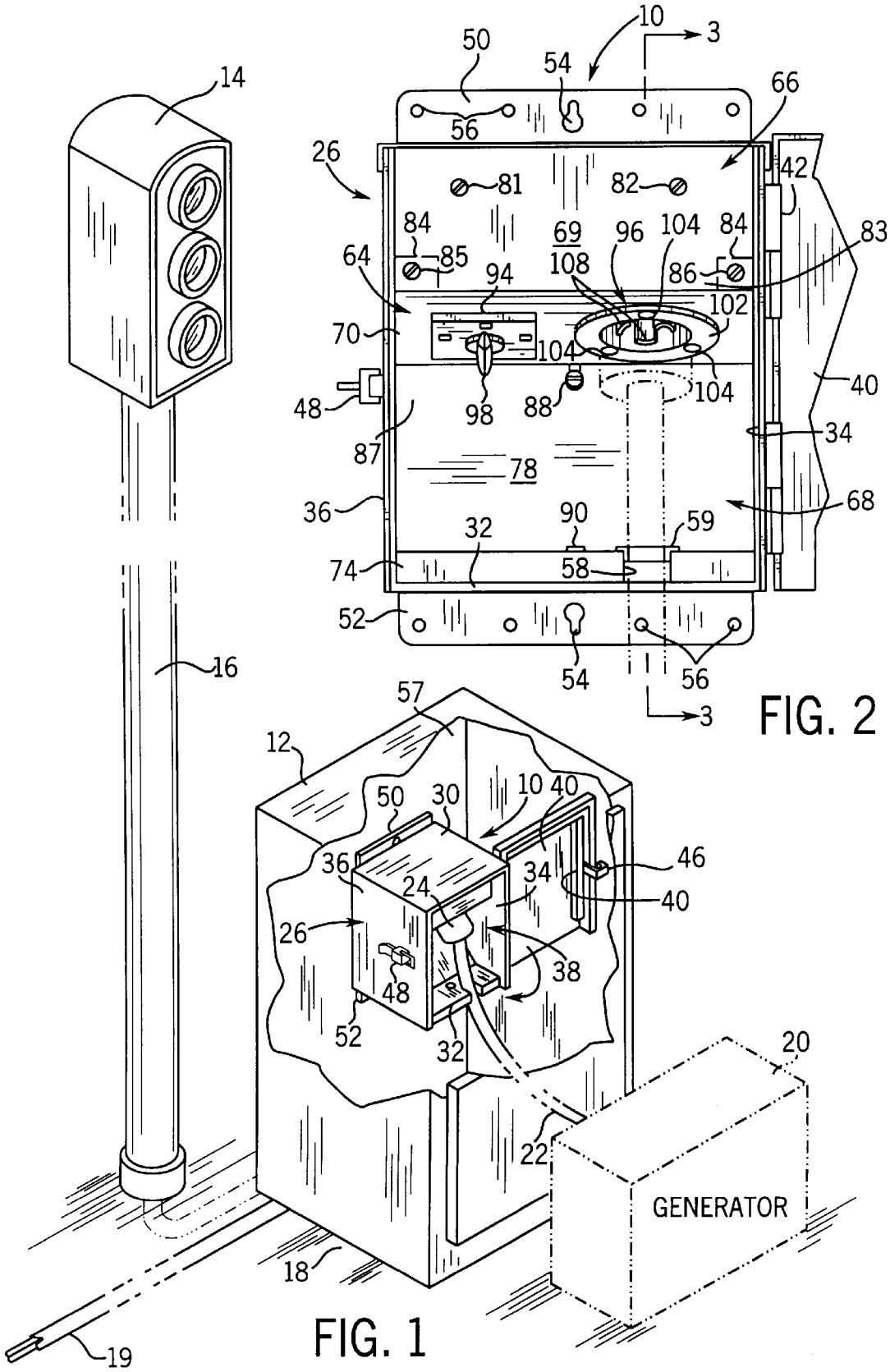
FIG. 1 is an isometric view showing a transfer switch in accordance with the present invention attached to a control box of a traffic signal normally powered by an electric utility source and connected with an alternate power source to the traffic signal in the event of an interruption in the electric utility source.
FIG. 2 is a partial front plan view of the transfer switch of FIG. 1.

Referring to FIG. 1, a power supply transfer switch 10 embodying the present invention is mounted inside a control box 12, which includes known components for controlling the sequencing and timing of a traffic signal 14 secured to the top of a support pole 16 anchored in the ground 18. A main power cable 19 normally supplying the primary power to operate traffic signal 14 typically runs downwardly through and from the bottom of support pole 16 underground to control box 12, and then to a remote power source, such as a utility power transformer. An alternate source of power in the form of a generator 20 is located adjacent to traffic signal 14 and may be permanently fixed, manually transported or mounted on a vehicle used to service the traffic signal 14. The generator 20 is equipped with a power cord 22 terminating in a plug 24 adapted to be received in the transfer switch 10.

While transfer switch 10 is illustrated as being located inside control box 12, it is understood that switch 10 may also be mounted to the outside of box 10 in order to eliminate the need for power cord 22 to extend into the interior of box 12.

In the preferred embodiment, transfer switch 10 is dedicated to providing an alternate power source for the traffic signal 14 should there be an interruption or power outage in the primary power supply. However, it should be understood that the transfer switch 10 may be used for a similar purpose with other electrical loads. For example, transfer switch 10 can be interconnected in the power supply system of certain medical apparatus, such as respirators and dialysis machines, where it is critical to provide electrical power over extended periods of time. It is also noted that transfer switch 10 does not have to be mounted directly adjacent its electrical load, but may be positioned at any point desired along the path of the power supply to the load.

Transfer switch 10 consists of a box-like enclosure 26 having a rear wall 28, a top wall 30, a bottom wall 32, a pair of side walls 34, 36 and an open face 38. A removable cover 40 is attached to one side wall 34 of enclosure 26 by a hinge assembly 42 that allows removable cover 40 to be pivoted about a vertical axis to selectively close and uncover the open face 38 of enclosure 26. Cover 40 is provided with a suitable gasket seal 44 on the inside periphery thereof so as to prevent the entry of undesirable environmental elements such as dirt and moisture when the cover 40 is in the closed position extending across the open face 38 of enclosure 26. A latch 46 located on cover 40 opposite hinge assembly 42 cooperates with a locking mechanism 48 positioned on the side wall 36 of enclosure 26 opposite hinge assembly 42. Locking mechanism 48 engages latch 46 and retains cover 40 in a closed, sealed position over the open face 38 of enclosure 26.

Enclosure 26 also includes a pair of mounting brackets 50, 52 extending vertically from the top and bottom edges, respectively, of the rear wall 28 of enclosure 26. Mounting brackets 50, 52 contain differently-sized mounting apertures 54, 56 which receive a set of mounting fasteners (not shown) that are driven into an internal wall 57 of the control box 12 to which the enclosure 26 is preferably mounted. Mounting brackets 50, 52 can also be used to secure enclosure 26 to any structure located adjacent signal light 14 or at any point along a path between the traffic signal 14 and the remote primary power source.

Figure 3:
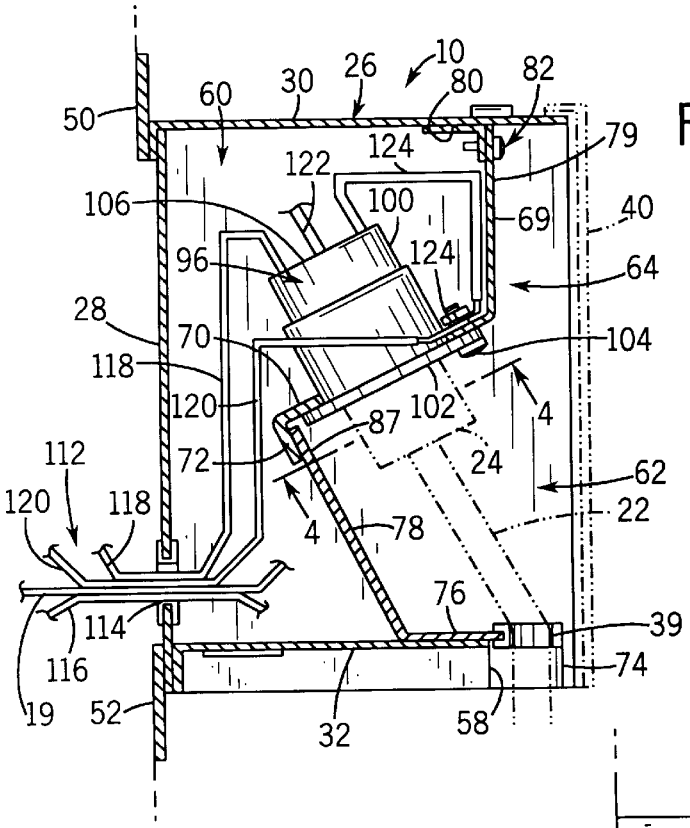
FIG. 3 is a cross-sectional view of the transfer switch of FIG. 2 along line 3—3 of FIG. 2.

Enclosure 26 also includes a retaining notch 58 with a liner 59 located in the front edge of the bottom wall 32 of enclosure 26 for snugly receiving and retaining power cord 22 during a primary power interruption. As shown in FIGS. 2 and 3, notch 58 allows power cord 22 to extend outward from enclosure 26 such that, when removable cover 40 is in its closed position, cover 40 does not contact or pinch power cord 22.

Figure 4:
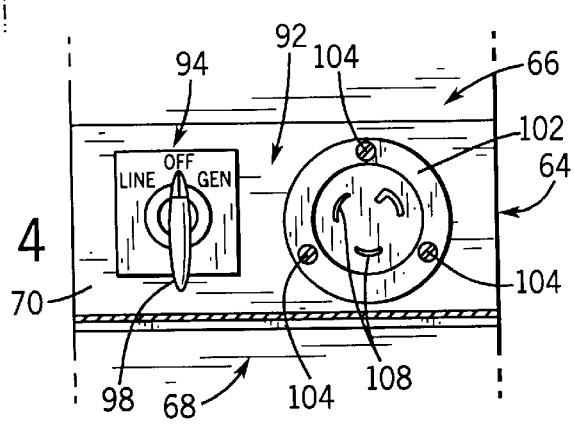
FIG. 4 is a cross-sectional view of the transfer switch of FIG. 3 along line 4—4 of FIG. 3.

The interior of enclosure 26 is shown in FIGS. 2, 3 and 4. Enclosure 26 is separated into an inner portion 60 and an outer portion 62 by a partition 64 extending between the top and bottom walls 30, 32 respectively, of enclosure 26. Partition 64 is substantially non-planar and is formed from an upper angled positioning plate 66, and a lower angled positioning plate 68. Upper angled positioning plate 66 has a downwardly extending vertical portion 69 integral with a mounting portion 70 extending downwardly and inwardly towards rear wall 28 and terminating in a support edge 72 lying substantially perpendicularly to mounting portion 70. Lower angled positioning plate 68 has a downwardly extending vertical step 74 integral with a rearwardly extending horizontal portion 76 and an upwardly and inwardly extending portion 78. Vertical portion 69 has a top edge 79 secured to a first pair of L-shaped brackets 80 (one being shown in FIG. 3) depending from top wall 30 by a pair of threaded screws 81, 82 in threaded engagement with suitable aligned openings formed in top edge 79 and brackets 80. Vertical portion 69 has a lower edge 83 joined to a second pair of L-shaped brackets 84 (FIG. 2) fixed to side walls 34, 36 by a pair of threaded screws 85, 86 in threaded engagement with suitable apertures formed in lower edge 83 and brackets 84. Upwardly and inwardly extending portion 78 has a top edge 87 bearing against support edge 72 and is secured thereto by a single threaded screw 88 in threaded engagement with aligned openings formed in the top edge 87 and the support edge 72. Horizontal portion 76 is attached to bottom wall 32 of enclosure 26 by a single threaded screw 90 (FIG. 2) in threaded engagement with aligned openings formed in horizontal portion 76 and bottom wall 32.

In accordance with the invention, an input arrangement 92 including a selector switch 94 and a power input receptacle 96 is incorporated in the power supply system for traffic signal 14. The input arrangement 92 selectively receives a plug connector in electrical communication with the generator, and selectively connects and disconnects the primary power source and the generator 20 with respect to the traffic signal 14.

Selector switch 94 and power input receptacle 96 are located and retained on mounting portion 70 of partition 64 so that they are accessible from the open face 38 of enclosure 26 when cover 40 is in the open position shown in FIG. 1. Selector switch 94 is typically attached with screws into a suitable opening formed in one end of mounting portion 70 and includes a rotatable handle 98 that is used to selectively connect traffic signal 14 with either main power line 19 or generator 20. As shown in FIG. 4, selector switch 94 has a LINE position, an OFF position and a GEN position, all of which will be described in greater detail hereafter. Power input receptacle 96 lies adjacent selector switch 94 on mounting portion 70 and includes a generally cylindrical body 100 that extends through a suitable circular opening in mounting portion 70 and extends into the inner portion 60 of enclosure 26 as seen in FIG. 3. A generally circular collar 102 extends generally perpendicularly from a face end of body 100 and is mounted in overlying fashion to the front of mounting portion 70 by a set of threaded screws 104 in threaded engagement with suitable aligned openings formed in the collar 102 and mounting portion 70. Body 100 defines an outwardly open internal cavity closed at its inner end by an end wall 106 spaced from collar 102 for mounting a set of outwardly projecting male prongs 108. When plug 24 is connected with power input receptacle 96 as shown in FIG. 5, prongs 108 enter female connector openings 110 in plug 24 and form an electrical connection with plug 24 allowing generator 20 to supply power through power input receptacle 96.

Wiring 112 connects selector switch 94, power input receptacle 96, operating circuitry of traffic signal 14 and main power line 19, and is contained in the inner portion 60 of enclosure 26 defined by partition 64 as illustrated in FIG. 3. A portion of wiring 112 exits enclosure 26 through a conduit in knock-out hole 114 located in the bottom portion of rear wall 28 of enclosure 26, i.e., knock-out hole 114 allows terminal ends of incoming power line 19 and a selector switch output line 116 to be inserted into enclosure 26 for connection to selector switch 94, and also allows a receptacle neutral line 118 to exit enclosure 26 for connection to the operating circuitry of traffic signal 14 and a receptacle ground line 120 to exit enclosure 26 for connection to a ground bar connector in control box 12.

Figure 5:
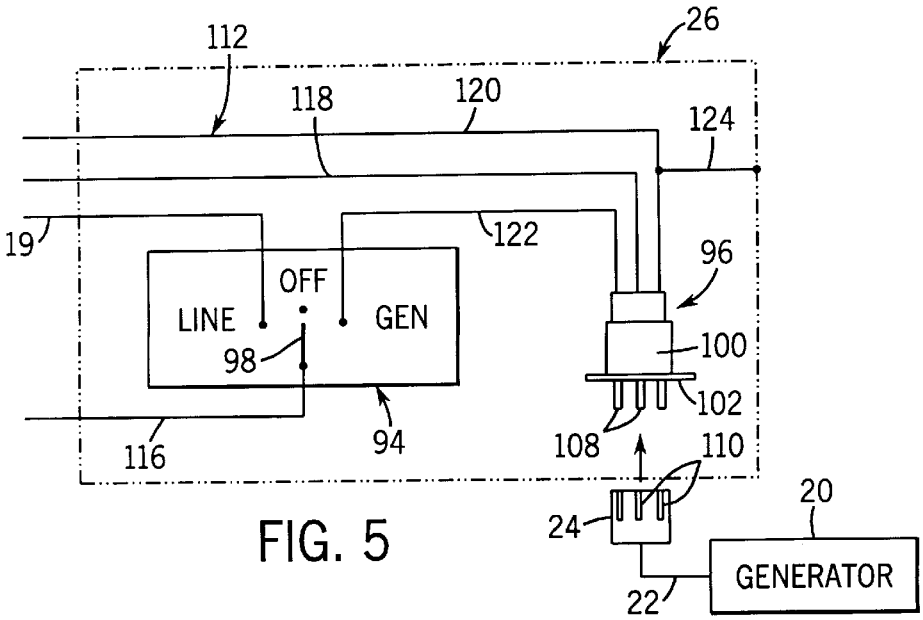
FIG. 5 is a schematic illustration of the wiring used in the transfer switch of FIG. 1.

FIG. 5 contains a schematic representation of components of wiring 112 and the connections made between selector switch 94 and power input receptacle 96. Selector switch 94 has hard-wired connections with incoming main power line 19, a receptacle supply line 122 leading from power input receptacle 96 and carrying the power supply from generator 20, and selector switch output line 116 which leads to operating circuitry of traffic signal 14. Rotatable handle 98 on selector switch 94 can be rotated to the LINE position to selectively connect selector switch output line 116 with main power line 19. Selector switch 94 can also be rotated to the GEN position to connect selector switch output line 116 with receptacle supply line 122, or it can be rotated to the OFF position to disconnect switch output line 116 from either power source. Wiring 112 includes receptacle neutral line 118 leading from traffic signal 14 to power input receptacle 96 and a ground wire 124 connected between a receptacle ground line 120 and the enclosure 26. As shown in FIG. 3, terminal ends of ground line 120 and ground wire 124 are engageable with uppermost screw 104 and retained thereon by a nut 126. To make transfer switch 10 as safe as possible, enclosure 26 and partition 64 are formed from an electrically conductive material, such as steel, to provide a good electrical ground for connection with ground wire 124, while selector switch 94 and power input receptacle 96 are formed from a non-conductive material, such as a plastic, to insulate the manually operable positions of transfer switch 10.

In the method contemplated by the invention, when the power supply through main power line 19 to the traffic signal 14 is interrupted, locking mechanism 48 is disengaged to release latch 46, and removable cover 40 is swung away from the open face 38 of enclosure 26, exposing selector switch 94 and power input receptacle 96. Rotatable handle 98 on selector switch 94 is rotated from the LINE position connecting selector switch output line 116 with main power line 19 to the OFF position in which the selector switch output line 116 is not connected to any power source. Next, plug 24 is inserted into power input receptacle 96, and power cord 22 connecting plug 24 and generator 20 is inserted within retainer notch 58. The opposite end of power cord 22 is then connected to generator 20, and generator 20 is then started according to its operating procedures. Then, rotatable handle 98 is rotated to the GEN position to connect selector switch output line 116 with receptacle supply line 122. Removable cover 40 is then closed over enclosure 26 and locked in place using latch 46 and locking mechanism 48. With this construction, the only period of interruption in operation of the traffic signal 14 is the time it takes to connect generator 20 to transfer switch 10, and the traffic signal 14 can thus be operated in normal manner with minimal disruption of service.

Once primary or utility power is restored, cover 40 is opened, rotatable handle 98 is turned to the LINE position to energize traffic signal 14 from the utility. Generator 20 is then shut down, and plug 24 is removed from power input receptacle 96 and power cord 22 is pulled from notch 58. Cover 40 is again closed and locked using latch 46 and locking mechanism 48.

While the above sequences in connecting and disconnecting generator 20 to and from traffic signal 14 are preferred, it is understood that the steps can be carried out in any sequence to accomplish the same end result.

It should thus be appreciated that the present invention provides a relatively simple, economical and secure power supply transfer switch which quickly and efficiently allows an alternate power source to be connected to an electrical load when the primary power source is interrupted. The present invention also provides a power transfer switch which can be safely mounted at any location in the power supply system for the electrical load. The power transfer device is particularly effective in traffic management so that, in the event of a power outage, power may be quickly restored to a traffic signal and optimal traffic flow can be maintained.

The invention has been shown and described in connection with supplying power to a traffic signal in the event of a power outage. However, it is understood that the invention may be employed in any application requiring a dedicated auxiliary power supply during a power interruption, such as a community well.

Various alternatives and embodiments are contemplated as being within the scope of the following claims particularly pointing out and distinctly claiming the subject matter regarded as the invention.

I claim:

1. A transfer switch adapted for interconnection in a power supply system for an electrical load having a control, for selectively switching power to the electrical load between a primary power source and an alternate power source, the transfer switch comprising:

an alternate power input arrangement interconnected in the power supply system, wherein the alternate power input arrangement includes engagement structure for selectively receiving a plug connector in electrical communication with the alternate power source, wherein the alternate power input arrangement is interconnected with the electrical load independent of the control of the electrical load; and a selector switch interconnected with the electrical load and with the primary power source and the alternate power input arrangement, wherein the selector switch is operable to selectively connect and disconnect the primary power source and the alternate power source with respect to the electrical load.

2. The transfer switch of claim 1, wherein the alternate power input arrangement includes a power input receptacle cooperable with the plug connector in electrical communication with the alternate power source, and wherein the selector switch is operably connected with the power input receptacle to selectively connect the alternate power source to the electrical load and cut off the supply of primary power to the electrical load.

3. The transfer switch of claim 2, wherein the selector switch includes a first position which is operable during periods of normal operation to allow power to be supplied from the primary power source connected to the load and a second position which is operable, in the event of an interruption of power from the primary power source, to supply power from the alternate power source to the loads, and a third position which is operable to disconnect the power input receptacle from both the primary power source and the alternate power source to enable the plug connector to be received in the power input receptacle.

4. The transfer switch of claim 2, wherein the power input receptacle and the selector switch are mounted in a box-like enclosure having a top wall, a bottom wall, a rear wall, and a pair of side walls defining an internal cavity having an open face, and having a partition mounted in the internal cavity between the top and bottom walls for dividing the internal cavity into an inner portion and an outer portion.

5. The transfer switch of claim 4, wherein the power input receptacle and the selector switch are both mounted on the partition such that the power input receptacle and the selector switch are accessible from the open face of the enclosure.

6. The transfer switch of claim 5, wherein the enclosure further includes a removable cover pivotally connected between open and closed positions relative to the open face by a hinge assembly located between the enclosure and the cover to selectively allow and prevent access to the power input receptacle and the selector switch.

7. The transfer switch of claim 6, wherein the cover includes a latch engageable with a locking mechanism secured on the enclosure opposite the hinge assembly.

8. The transfer switch of claim 4, wherein the power input receptacle and the selector switch are interconnected to the load, the primary power source, the alternate power source and a ground connection on the enclosure by wiring retained in the inner portion of the enclosure.

9. The transfer switch of claim 8, wherein the rear wall of the enclosure is formed with a knock-out opening through which the wiring extends.

10. The transfer switch of claim 6, wherein the bottom wall of the enclosure is provided with a retainer notch allowing a power cord leading from the plug connector to the alternate power source to extend freely from the enclosure when the cover is in the closed position over the outer portion of the enclosure.

11. The transfer switch of claim 4, wherein the partition includes an upper angled positioning plate having a mounting portion and a lower angled positioning plate connected thereto.

12. The transfer switch of claim 11, wherein the power input receptacle extends through and is fixed to the mounting portion of the partition.

13. The transfer switch of claim 12, wherein the power input receptacle includes a cylindrical body and a circular collar extending generally perpendicularly to the body at one end thereof and overlying the mounting portion of the partition.

14. The transfer switch of claim 13, wherein the power input receptacle further includes an end wall spaced from the collar for mounting a set of male prongs receivable in the plug connector connected to the alternate power source.

15. The transfer switch of claim 2, wherein the selector switch is connected to an incoming primary power supply wire and an incoming alternate power supply wire from the power input receptacle, and to an outgoing power supply wire from the selector switch leading to the load, the selector switch being selectively connectable to either incoming power supply wire.

16. The transfer switch of claim 15, wherein the selector switch includes a rotatable handle selectively engageable in the first and second positions with the incoming power supply wires to define closed electrical circuits with the desired power source, and selectively engageable in the third position to disconnect the load from both of the incoming power supply wires.

17. The transfer switch of claim 1, wherein the load is a traffic signal.

18. The transfer switch of claim 17, wherein the transfer switch includes an enclosure mounted to a control box positioned between the traffic signal and the primary power source.

19. The transfer switch of claim 17, wherein the transfer switch includes an enclosure mounted on a support device adjacent the traffic signal.

20. A transfer switch connected to an electric traffic signal having a control, for switching power from an electrical utility source to a generator power source in the event of an interruption in the electrical utility source, the transfer switch comprising:

an enclosure operably connected to the transfer signal;

a power input receptacle located within the enclosure for selectively receiving the generator power source independent of the control of the traffic signal; and a selector switch located within the enclosure and cooperable with the power input receptacle for connecting the generator power source to the traffic signal and effecting a cut off in the supply of power to the traffic signal from the electrical utility source.

21. A method of providing a transfer of power to an electrical load having a control from an electrical utility power source to a generator power source, the method comprising the steps of:

providing an enclosure having a power input receptacle independent of the control of the electrical load, a selector switch having connections with incoming power supply wires from both the electrical utility power source and the generator power source and with the power input receptacle, and with an outgoing power supply wire leading to the load, and a movable cover interconnected with the enclosure for selectively allowing and preventing access to the power input receptacle and the selector switch;

moving the cover so as to expose the power input receptacle and the selector switch;

moving the selector switch from a first operative position connecting the incoming power supply wire from the utility power source with the outgoing power supply wire, to a second operative position in which the outgoing power supply wire is connected to the incoming power supply wire from the generator power source; and inserting a plug leading from the generator power source into the power input receptacle.

22. The method of claim 21, wherein the step of moving the cover includes releasing a locking mechanism on an exterior surface of the enclosure which is engageable with a latch attached to the cover, and moving the cover away from the enclosure.

23. The method of claim 21, wherein the step of moving the selector switch comprises rotating a handle located on the selector switch.

24. The method of claim 21, wherein the step of inserting the plug further includes joining the plug with the power input receptacle and placing a power cord trailing from the plug into a retainer notch formed in a bottom wall of the enclosure.

25. The method of claim 22, further comprising the steps of:

closing the movable cover on the enclosure, and locking the cover by engaging the latch on the cover with a locking mechanism on the enclosure.

* * * * *